US008733594B1

(12) United States Patent
White et al.

(10) Patent No.: US 8,733,594 B1
(45) Date of Patent: May 27, 2014

(54) BAG IN BOX BEVERAGE DISPENSER

(76) Inventors: Richard W. White, Lake Worth, FL (US); Robert J. White, Lake Worth, FL (US)

( * ) Notice: Subject to any disclaimer, the term of this patent is extended or adjusted under 35 U.S.C. 154(b) by 0 days.

(21) Appl. No.: 13/507,095

(22) Filed: Jun. 4, 2012

(51) Int. Cl.
*B65D 35/56* (2006.01)

(52) U.S. Cl.
USPC ..... 222/105; 222/185.1; 222/130; 222/108; 211/71.01

(58) Field of Classification Search
CPC ..... B65D 77/067; B67D 1/16; B67D 3/0009
USPC ..... 222/93, 105, 94, 92, 106, 129.1, 108, 222/185.1, 181.1; 211/71.01, 162; 62/389; 248/127, 152; 141/88, 86, 369, 370, 141/375; 312/326
See application file for complete search history.

(56) References Cited

U.S. PATENT DOCUMENTS

| | | | | | |
|---|---|---|---|---|---|
| 4,699,342 | A | | 10/1987 | Bartz | |
| 4,811,872 | A | * | 3/1989 | Boyd | 222/610 |
| 5,469,708 | A | * | 11/1995 | Harrison et al. | 62/3.64 |
| 5,740,928 | A | | 4/1998 | Dale | |
| D425,375 | S | * | 5/2000 | Parham | D7/619.1 |
| 6,158,623 | A | * | 12/2000 | Benavides et al. | 222/129 |
| 6,334,329 | B1 | | 1/2002 | Weller | |
| 6,554,164 | B1 | | 4/2003 | Jones | |
| 6,595,475 | B2 | | 7/2003 | Svabek | |
| 6,840,592 | B2 | * | 1/2005 | Kalieta et al. | 312/326 |
| 7,131,545 | B1 | * | 11/2006 | Grogan | 211/85.29 |
| 7,137,533 | B1 | | 11/2006 | Heath | |
| 7,464,567 | B1 | | 12/2008 | Crossley | |
| 2010/0243588 | A1 | * | 9/2010 | LaRiviere | 211/71.01 |
| 2011/0049314 | A1 | * | 3/2011 | Yoon | 248/146 |
| 2011/0056983 | A1 | * | 3/2011 | Hackleman et al. | 222/105 |
| 2011/0289958 | A1 | * | 12/2011 | White et al. | 62/465 |
| 2012/0292346 | A1 | * | 11/2012 | Watson et al. | 222/185.1 |
| 2012/0305595 | A1 | * | 12/2012 | Braun et al. | 222/105 |

* cited by examiner

*Primary Examiner* — Paul R Durand
*Assistant Examiner* — Jeremy W Carroll
(74) *Attorney, Agent, or Firm* — Alvin S. Blum

(57) ABSTRACT

A rigid stand holds bag-in-box containers of liquid to be dispensed from an outlet near the bottom of the container. A platform suspends the containers above a support surface high enough so that the outlet is at least 12 centimeters above the support surface for a cup or glass to fit under the outlet. The stand includes a base panel for sitting on the support surface. Upstanding from first and second sides of the base panel are two wall panels. The platform affixed to each wall panel holds the platform at an angle of at least eight degrees from the base panel. Upstanding from the lower edge of the platform is a ridge that extends upwardly enough to hold the box from sliding forward but low enough to not interfere with dispensing.

11 Claims, 7 Drawing Sheets

BAG IN BOX BEVERAGE DISPENSER

This application claims the benefit of Provisional Patent Application Ser. No. 61/520,224 filed Jun. 7, 2011, incorporated herein by reference.

BACKGROUND OF THE INVENTION

This invention relates to self-contained portable apparatus for dispensing beverages from a plurality of containers for consumption by consumers, and more specifically to such apparatus for dispensing beverage from bag-in-box containers into drinking receptacles supported on a surface.

Bag-in-box beverage packages are often produced for providing a large volume, 1.5 liters or more, of wine in a package that dispenses wine without admitting air. Other beverages are now being marketed in this manner. They are more economical than bottles, easier to handle, and environmentally friendly. They have a dispensing outlet at a low position, so that the outlet must be positioned over the edge of a support surface. A drinking receptacle must then be hand held below the outlet for filling. This is awkward when dispensing many portions at a public gathering. To dispense the last liquid from the container, the box must be tilted up. Heath in U.S. Pat. No. 7,137,533 teaches a wine box with a retractable stand to tilt the box up to encourage efficient emptying.

SUMMARY OF THE INVENTION

It is accordingly an object of the invention to provide a self-contained portable apparatus for dispensing beverages from many bag-in box containers that may be used in a bartending operation. When wine is being served, it is common to offer at least one red and one white wine choice. Bag-in-box wine packages are most economical. They hold a large volume, and they are more easily handled that bottles. Because they do not admit air, the contents are more stable.

The invention provides a rigid stand for holding one or more bag-in-box containers of liquid, the liquid to be dispensed from an outlet located near the bottom of the box container. The stand provides a planar rectangular platform upon which the containers are rested suspended above a substantially planar support surface. Each container is suspended above the support surface high enough so that the outlet will be at least 12 centimeters above the support surface to thereby enable a receptacle such as a cup or glass to fit under the outlet to receive liquid while resting on the planar support surface. The stand includes a base panel adapted for sitting on a substantially flat horizontal support surface. Upstanding from opposed first and second sides of the base panel are two wall panels. The rectangular platform is affixed to each of the wall panels so as to hold the platform at an angle of at least eight degrees from the base panel, with one edge of the platform affixed to a wall panel being lower than the opposed edge of the platform. Upstanding from the lower edge of the platform is a ridge that extends upwardly enough to hold the box from sliding forward but low enough to not interfere with dispensing from the outlet. A perforated mat on an absorbent towel may be provided on the support surface to hold the apparatus and catch any dripping. A set of rubbery bumpers may be provided under the base panel to stabilize the stand on the support surface.

In an alternative embodiment, the base panel extends beyond the wall panel far enough to provide a support for the receptacle under the outlet.

These and other objects, features, and advantages of the invention will become more apparent from the detailed description of exemplary embodiments thereof as illustrated in the accompanying drawings.

Figure 1:
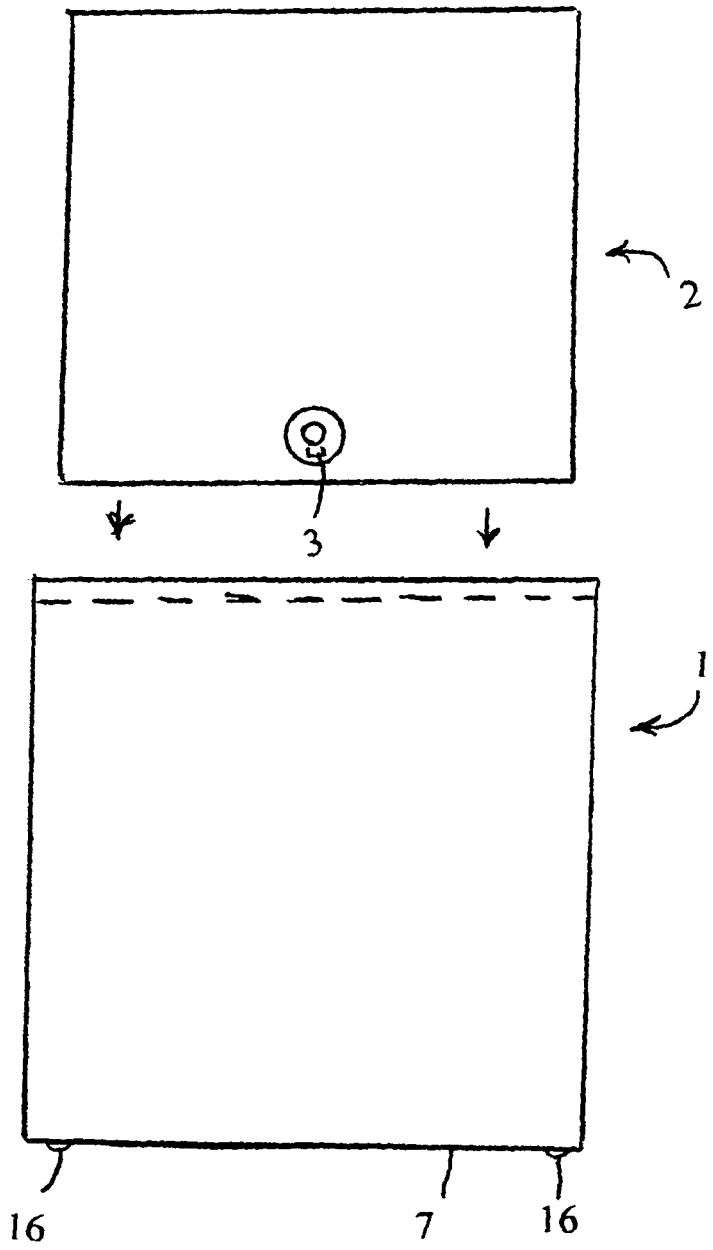
FIG. 1 is a front elevation view of the invention.
Figure 2:
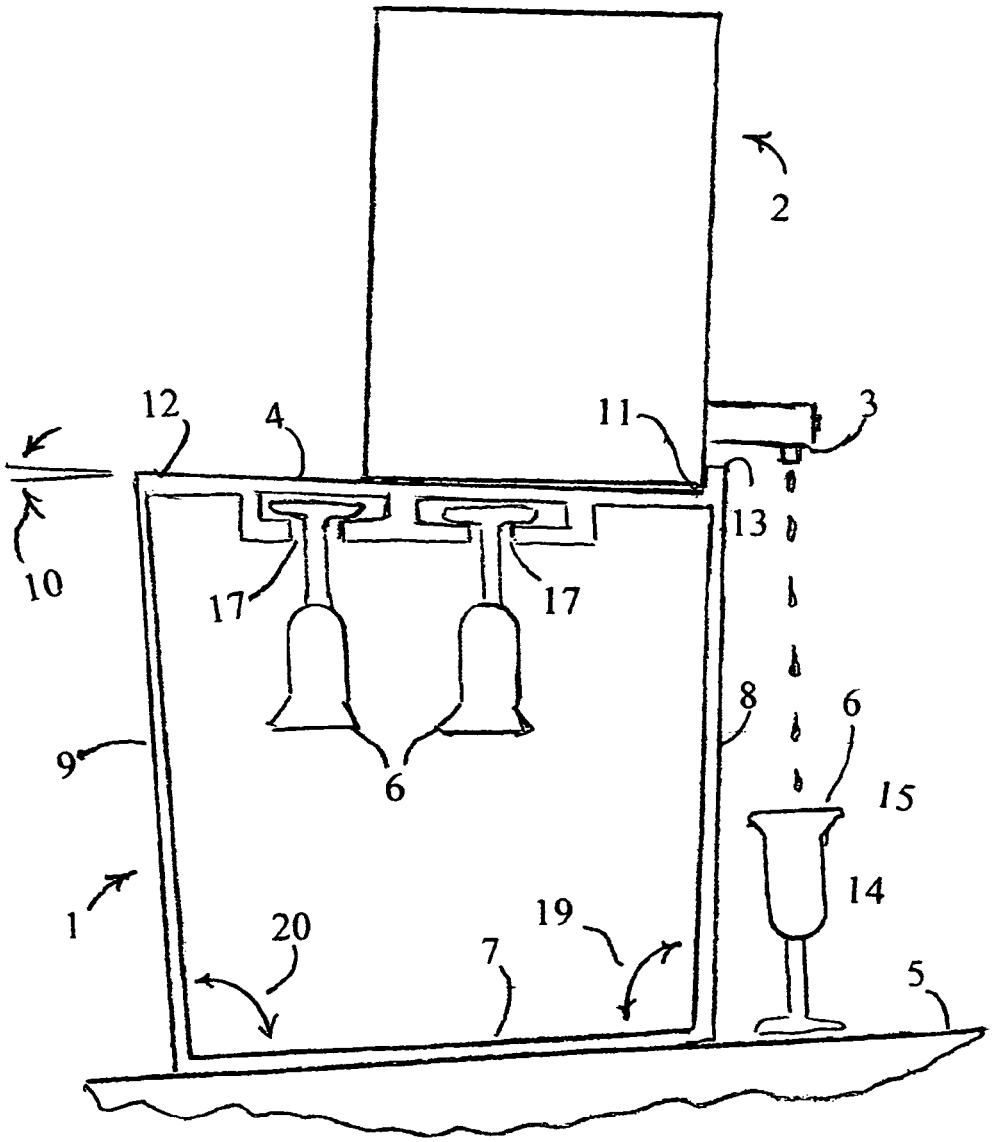
FIG. 2 is a side view of the invention.

Referring now to the drawing FIGS. 1-4, a preferred embodiment of the portable beverage box dispensing stand is shown. The invention provides a rigid stand 1 for holding one or more bag-in-box containers 2 of liquid, the liquid to be dispensed from an outlet 3 located near the bottom of the box. The term outlet is used here to designate any of the faucets, valves and spigots used to dispense liquids from the container. The stand provides a planar rectangular platform 4 upon which the containers are rested suspended above a substantially planar support surface 5. Each container is suspended above the support surface high enough so that the outlet 3 will be at least 12 centimeters above the support surface or of sufficient height to enable a receptacle such as a cup or glass 6 to fit under the outlet to receive liquid while resting on the support surface. The stand includes a rectangular base panel 7 adapted for sitting on a substantially flat horizontal support surface 5. Upstanding from opposed first and second sides of the base panel are two wall panels, a front wall panel 8, and a back wall panel 9. The front panel 8 is tilted forward at an inner angle 19 of about 98 degrees from the base panel. The rear panel 9 may be at an inner angle 20 of about ninety degrees to the base panel. By making the wall panels non-parallel, the structure becomes more rigid. The rectangular platform 4 is affixed to each of the wall panels so as to hold the platform at an angle 10 of at least eight degrees from the base panel, with one edge 11 of the platform affixed to wall panel 8 being lower than the opposed edge 12 of the platform. The forward tilt of the front panel and the tilt of the platform extend the outlet forward of the base panel to facilitate placement of a receptacle under the outlet, drainage of the last portion of the beverage, and prevent rearward movement of the box. Upstanding from the lower edge 11 of the platform is a ridge 13 that extends upwardly enough to hold the box from sliding forward but low enough to not interfere with dispensing from the outlet. A perforated rubbery mat 14 on an absorbent towel 15 may be provided on the support surface to hold the apparatus and catch any dripping. The space inside the stand may be used to store cups or glasses for use. One or more tracks 17 may be provided on the underside of the platform 4 to hold inverted stemware 6 if desired.

Figure 3:
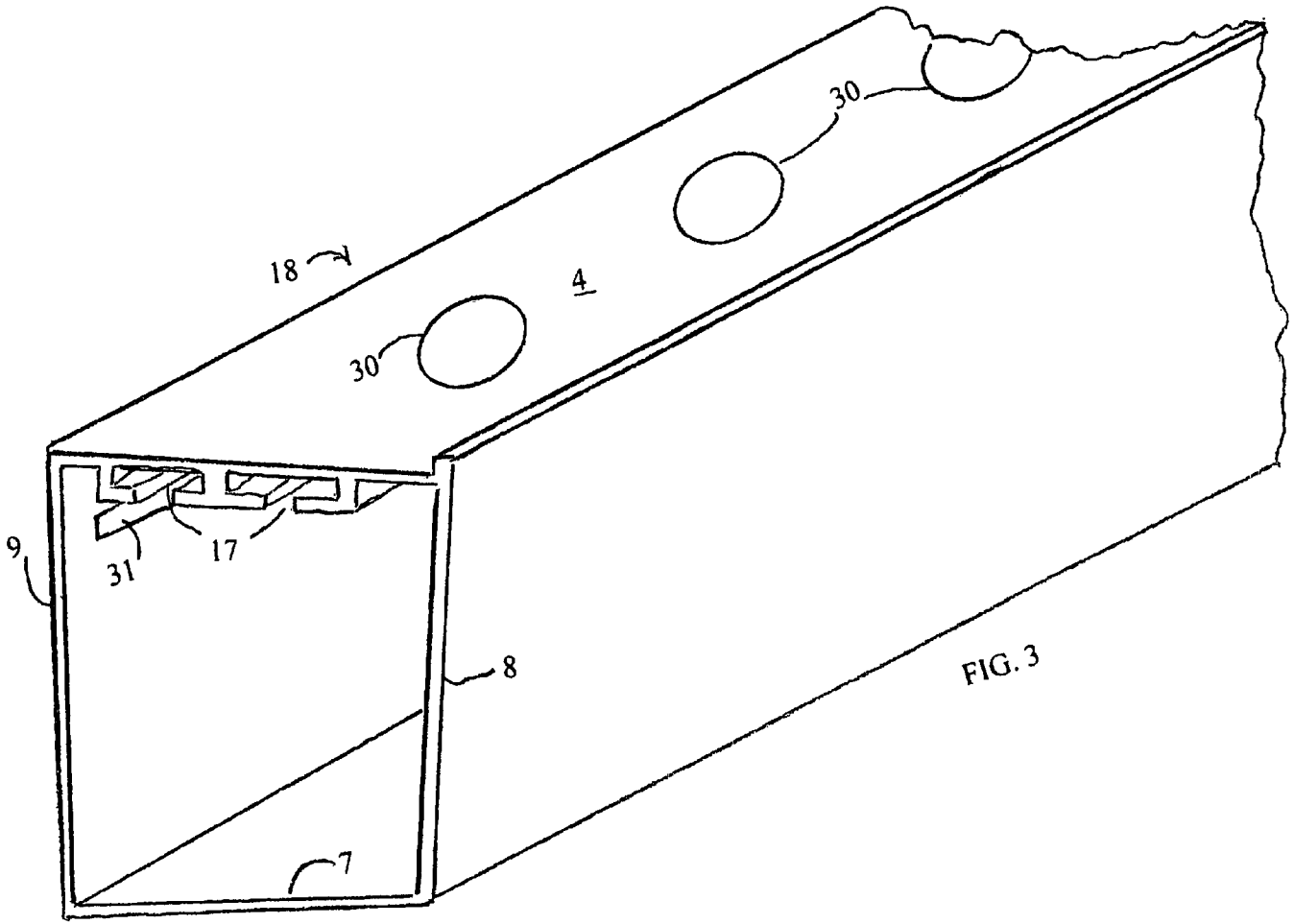
FIG. 3 is perspective view of an extrusion prior to being cut into the dispensers of FIG. 2.
Figure 4:
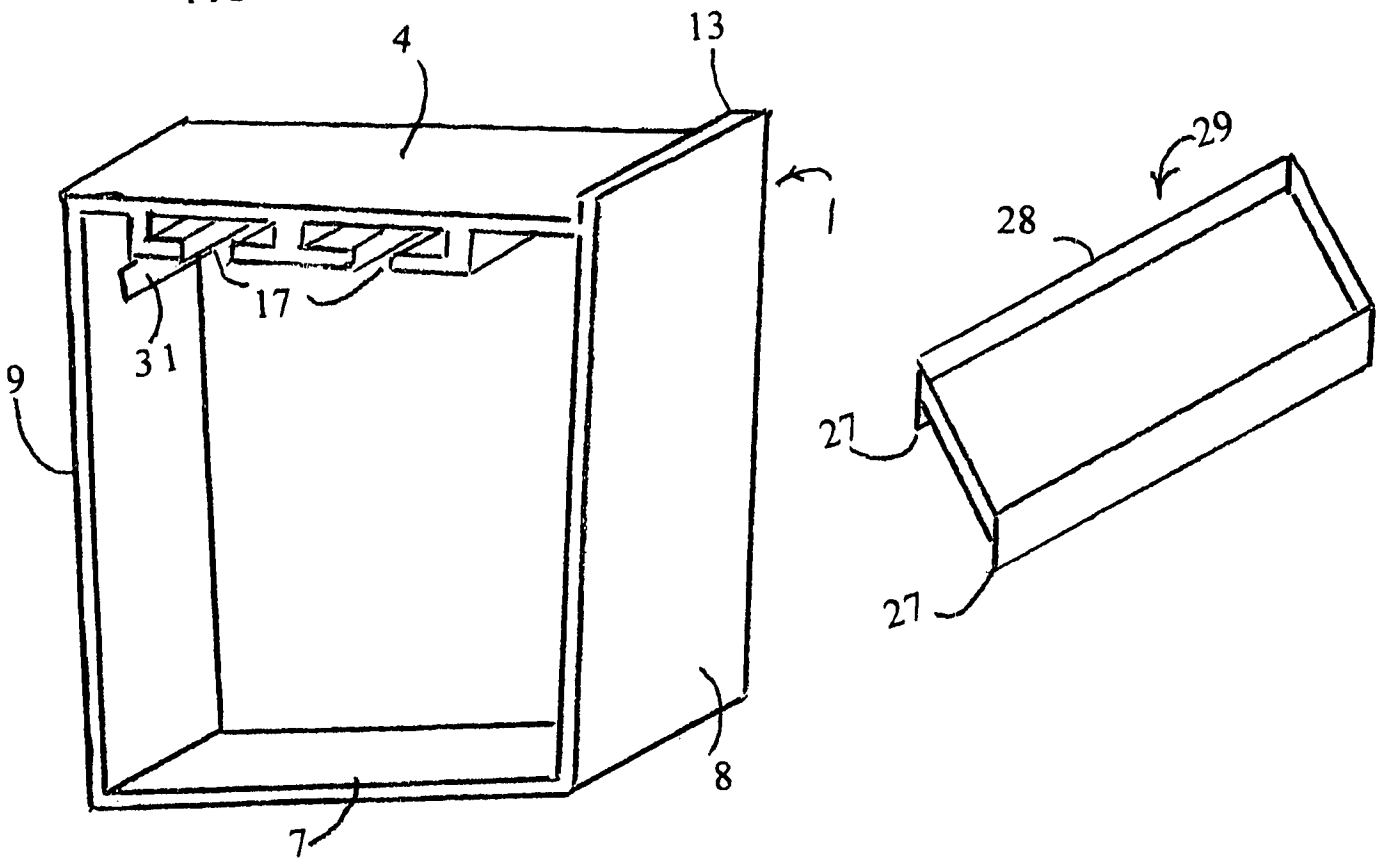
FIG. 4 is a perspective view of dispenser with box and tray in carrying mode.

This embodiment of the stand is monolithic in structure for enhanced rigidity and economy of manufacture. The term monolithic as used herein is meant to refer to homogenous, or of one piece of material, it has a uniform cross section so as to provide a structure that may be manufactured by molding, part assembly, or by extrusion. An extrusion 18 prior to cutting into individual stands 1 is shown in FIG. 3. Apertures 30 in the top platform may be provided to hold a supply of cups or glasses. Aperture 31 in the rear panel may serve as a handhold for carrying the dispenser. A tray 29 may be provided to fit under the outlet to catch any drips. It has an elevated rim 28. In addition, it has legs 27. The tray fits into the dispenser so that it can be carried with it. The legs 27 extend below the base panel, so that it will not slide out when carried by the handhold 31.

Figure 5:
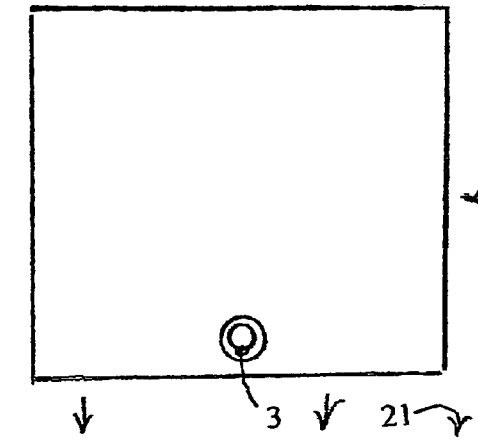
FIG. 5 is a front elevation view of another embodiment of the invention.
Figure 6:
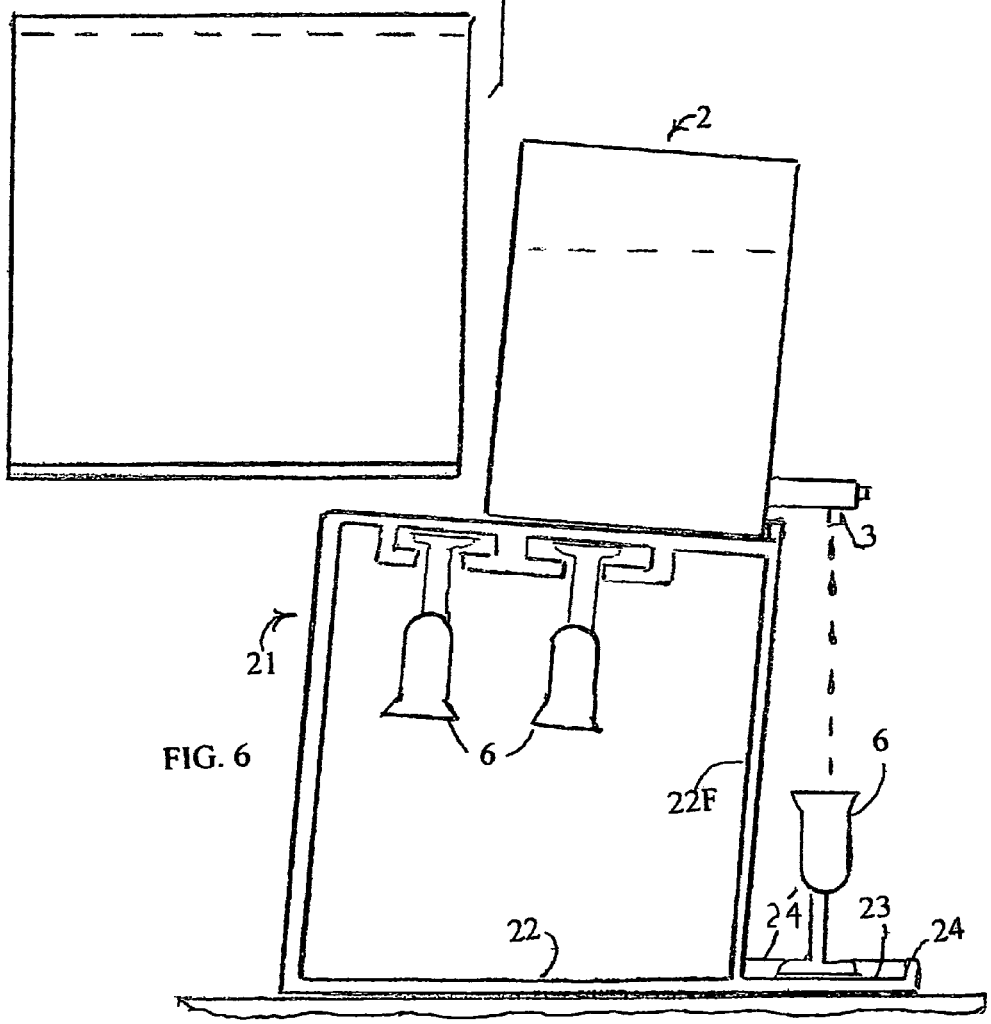
FIG. 6 is a side view of the invention of FIG. 5.
Figure 7:
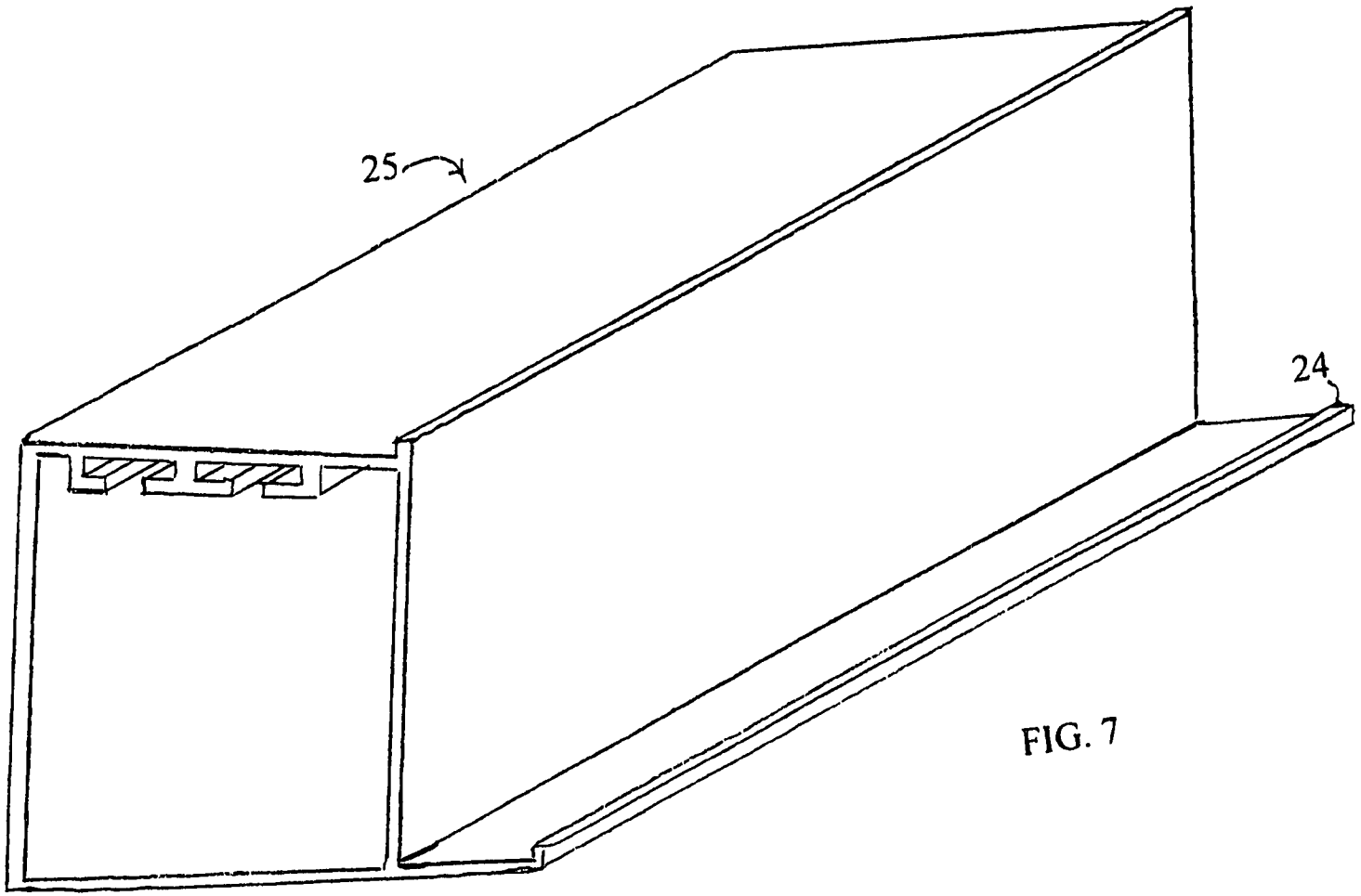
FIG. 7 is perspective view of an extrusion prior to being cut into the dispensers of FIG. 6.

Referring now to FIGS. 5-7, an alternative embodiment shows stand 21, in which the base panel 22 has an extension 23 that extends beyond the front wall panel 22F far enough to provide stability and a support for the receptacle 6 under the outlet 3. An upstanding lip 24 may optionally be provided to enhance the placement of the receptacle 6.

It may be manufactured by extrusion. The extrusion 25 prior to cutting into individual stands 21 is shown in FIG. 7. Optional retaining walls 24 may be added to the extended base portion 23 sufficiently to retain inadvertent drops from the outlet.

Figure 8:
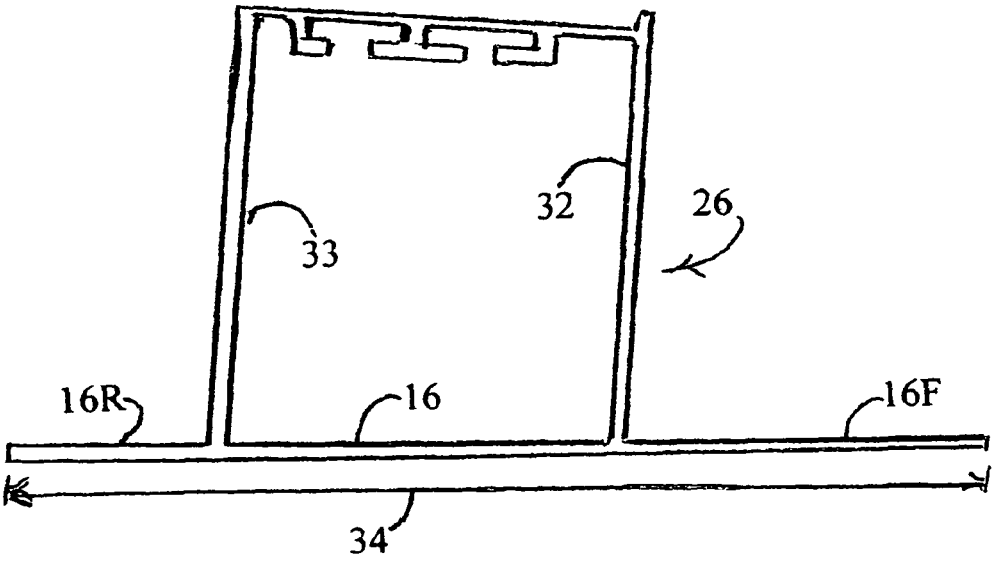
FIG. 8 is a side view of another embodiment of the invention.

Referring now to FIG. 8, an alternative embodiment shows stand 26.

The base panel 16 has an extension 16F that extends beyond the front wall panel 32, and an extension 16R that extends beyond the rear wall panel 33. The distance 34 that the two extensions 16F and 16R span is arranged to enable the ends of 16F and 16R to rest upon two opposed shoulders of a ridge formed on the upper portion of an insulated portable cooler (not shown) well known in the art. The stand can be inverted for transport and storage with the stand resting on the shoulder so that the cooler may be closed.

While we have shown and described the preferred embodiments of our invention, it will be understood that the invention may be embodied otherwise than as herein specifically illustrated or described, and that certain changes in form and arrangement of parts and the specific manner of practicing the invention may be made within the underlying idea or principles of the invention.

What is claimed is:

1. A rigid stand for holding and dispensing liquid from one or more bag-in-box containers of liquid, the liquid to be dispensed from an outlet located at a front face of the box container near the bottom of the box container, the stand comprising:

a rectangular base panel constructed for resting on a substantially flat horizontal support surface;

first and second spaced-apart opposed wall panels upstanding from the base panel;

a planar rectangular platform constructed to support the one or more containers suspended above the planar support surface with the outlet extending beyond the platform at least 12 centimeters above the support surface to thereby enable a receptacle such as a cup or glass to fit under the outlet to receive liquid while resting on a support surface;

the rectangular platform affixed to each of the wall panels so as to hold the platform at an angle of at least eight degrees from the base panel, with one edge of the platform affixed to a wall panel being lower than the opposed edge of the platform; and a ridge upstanding from the lower edge of the platform extending upwardly enough to hold the box from sliding off the platform but low enough to enable the outlet to extend past the ridge.

2. The stand of claim 1 being monolithic in structure with a uniform cross section to thereby enable fabrication by extrusion.

3. The stand of claim 1 further comprising tracks on the underside of the platform adapted to hold inverted stemware.

4. The stand of claim 1 further comprising an aperture in the platform constructed to support a supply of receptacles.

5. A rigid stand for holding and dispensing liquid from one or more boxes of liquid, the liquid to be dispensed from an outlet located at a front face of the box near the bottom of the box, the stand comprising:

a rectangular base panel constructed for resting on a substantially flat horizontal support surface;

first and second spaced-apart opposed wall panels upstanding from the base panel;

the first wall panel disposed at an inner angle of ninety degrees to the base panel;

the second wall panel disposed at on inner angle greater than ninety degrees to the base panel;

a planar rectangular platform constructed to support the one or more boxes suspended above the planar support surface with the outlet extending beyond the platform at a height above the support surface sufficient for dispensing the liquid from the outlet into a receptacle such as a cup or glass to fit under the outlet to receive liquid;

the rectangular platform affixed to each of the wall panels so as to hold the platform at an angle of at least eight degrees from the base panel, with one edge of the platform affixed to the second wall panel being lower than the opposed edge of the platform; and a ridge upstanding from the lower edge of the platform extending upwardly enough to hold the box from sliding off the platform but low enough to enable the outlet to extend past the ridge.

6. The stand of claim 5 being monolithic in structure with a uniform cross section to thereby enable fabrication by extrusion.

7. The stand of claim 5 further comprising tracks on the underside of the platform adapted to hold inverted stemware.

8. The stand of claim 5 further comprising an aperture in the platform constructed to support a supply of receptacles.

9. The stand of claim 5 further comprising an aperture in the first wall panel constructed to provide a handhold.

10. The stand of claim 9 further comprising a rectangular tray having an upstanding rim and legs descending from the tray to enable the tray to sit securely within the stand when the stand is lifted by the handhold.

11. A rigid stand for holding and dispensing liquid from one or more boxes of liquid, the liquid to be dispensed from an outlet located at a front face of the box near the bottom of the box, the stand comprising:

a rectangular base panel constructed for resting on a substantially flat horizontal support surface;

first and second spaced-apart opposed wall panels upstanding from the base panel;

a planar rectangular platform constructed to support the one or more boxes suspended above the planar support surface with the outlet extending beyond the platform at a height above the support surface sufficient for dispensing the liquid from the outlet into a receptacle such as a cup or glass to fit under the outlet to receive liquid while resting on a support surface;

the rectangular platform affixed to each of the wall panels so as to hold the platform at an angle of at least eight degrees from the base panel, with one edge of the platform affixed to the second wall panel being lower than the opposed edge of the platform;

a ridge upstanding from the lower edge of the platform extending upwardly enough to hold the box from sliding off the platform but low enough to enable the outlet to extend past the ridge; and the rectangular base portion adapted to extend forward of the outlet sufficiently to enable the receptacle to rest thereon.

* * * * *